US005315686A

United States Patent [19]

Caugherty et al.

[11] Patent Number: 5,315,686

[45] Date of Patent: May 24, 1994

[54] ELECTRICALLY HEATED NOZZLE FOR DIE CASTING

[76] Inventors: William Caugherty, 10605 Oak Valley Rd., Fort Wayne, Ind. 46845; Harold Booton, 19990 23 Mile Rd., Marshall, Mich. 49068

[21] Appl. No.: 692,114

[22] Filed: Apr. 26, 1991

[51] Int. Cl.[5] ..... B67D 5/62; B22D 35/06; B22D 41/015; B22D 41/05

[52] U.S. Cl. ..... 392/480; 222/146.5; 222/593

[58] Field of Search ..... 392/473, 474, 475, 476, 392/477, 480; 219/230, 421; 222/146.5, 590, 591, 592, 593

[56] References Cited

U.S. PATENT DOCUMENTS 4,196,855 4/1980 Osuna-Diaz ..... 239/135
4,386,262 5/1983 Gellert ..... 222/146.5
4,635,851 1/1987 Zelman ..... 222/593
4,638,849 1/1987 Whitehorn ..... 164/311

FOREIGN PATENT DOCUMENTS 3640620 6/1987 Fed. Rep. of Germany ... 222/146.5
1212823 2/1986 U.S.S.R. ..... 222/146.5

*Primary Examiner*—Bruce A. Reynolds
*Assistant Examiner*—Michael D. Switzer
*Attorney, Agent, or Firm*—Weintraub, DuRoss & Brady

[57] ABSTRACT

An electrically heated nozzle for use in injection molding is positionable between an injection apparatus and a die in an injection molding operation. The disclosed nozzle is formed in three sections an end cap integrally formed with a sleeve, a housing surrounding the sleeve, and a nozzle tip also surrounding the sleeve forwardly of the housing. A coil of electrical resistance heating wire is wrapped around the sleeve inside the housing. A control box is provided for varying the current flow to the coil heater wire.

8 Claims, 2 Drawing Sheets

FIG 1
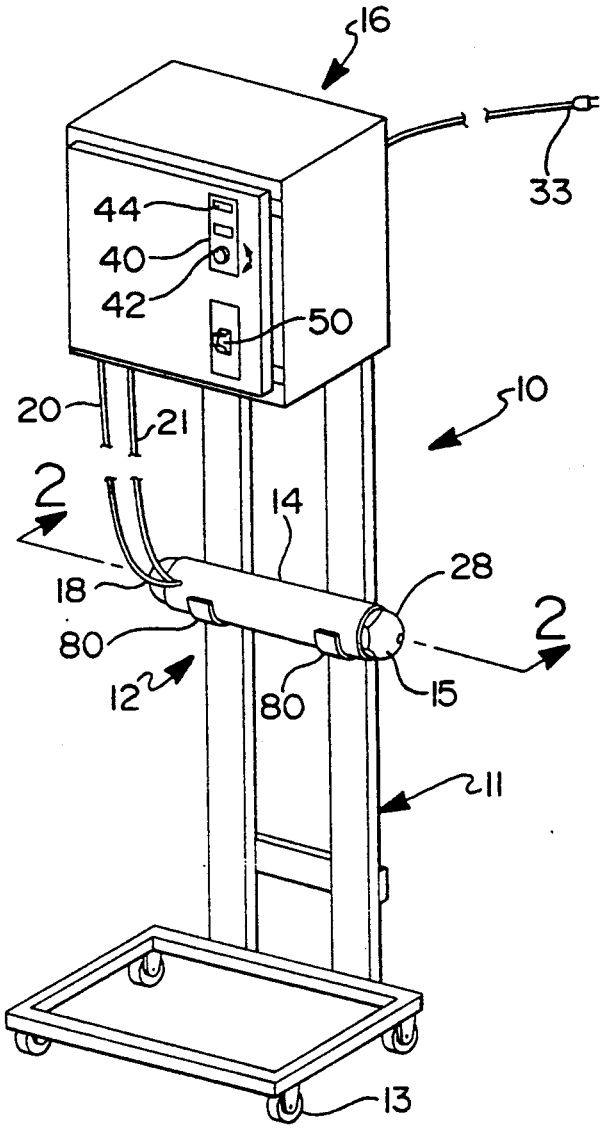
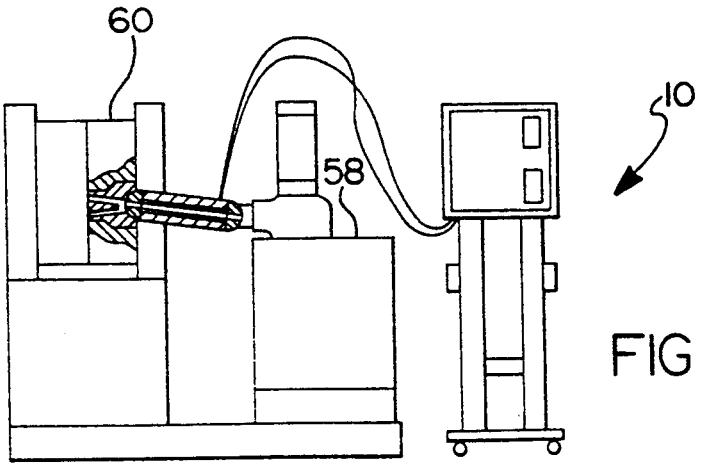
FIG 3

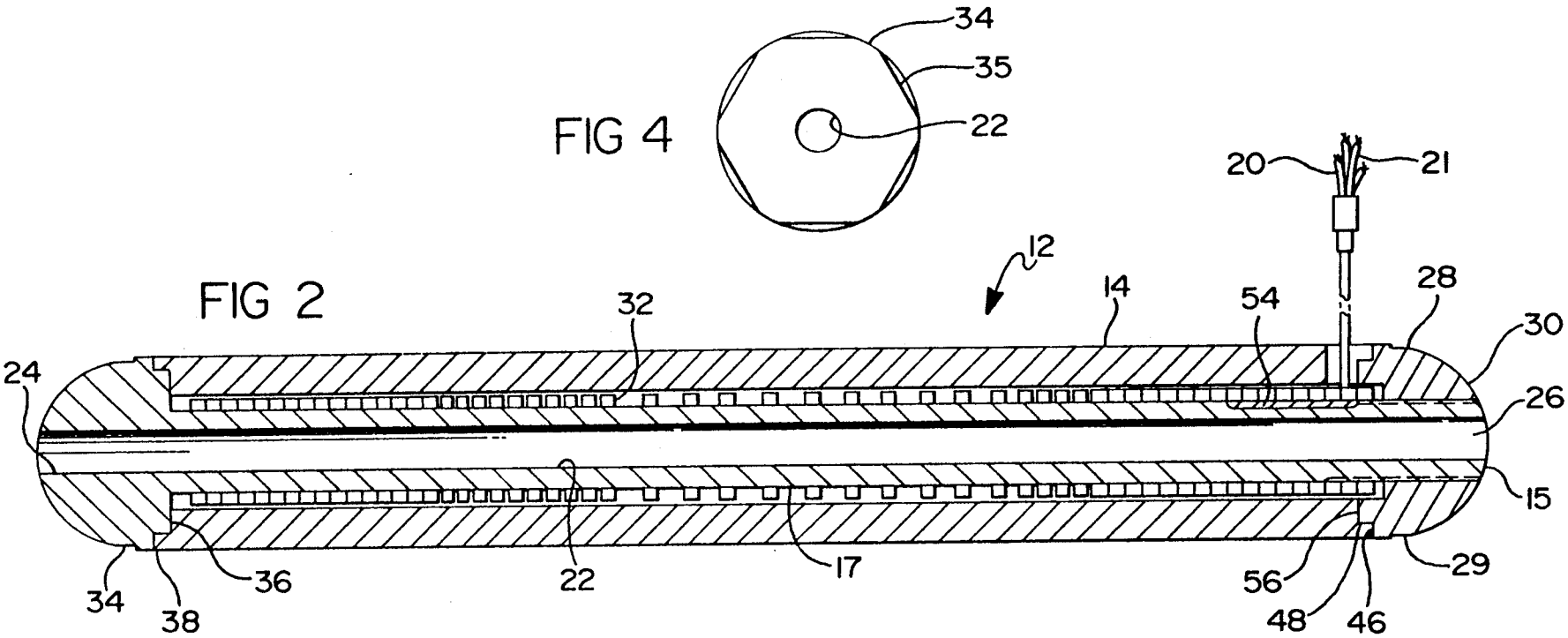
FIG 2
FIG 4
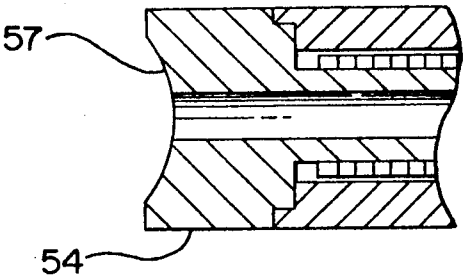
FIG 5

ELECTRICALLY HEATED NOZZLE FOR DIE CASTING

BACKGROUND OF THE INVENTION

1. Field of the Invention

The present invention relates to an electrically heated nozzle assembly for use in a metal die casting process.

2. Prior Art

In the die casting of metals, it has been known in the art to place a nozzle between a die and an apparatus for injecting molten metal into the die. The use of such a nozzle is discussed briefly in Chapter 3 of *Pressure Die Casting Part One* by B. Upton, published in 1982 by Pergamon Press Limited. However, prior art die casting nozzles lacked the ability to achieve a consistent temperature throughout the nozzle, and sometimes the molten metal would begin to solidify within such a prior art nozzle, thus restricting flow.

The prior art die-casting nozzles were usually heated externally with a blow torch, which caused hot spots within the nozzle, and which created external environmental problems such as creating a fire hazard and heating up the work area to the extent that it became uncomfortable for the machine operator.

One effort has been made by DME to market an electrically heated nozzle for use in die-casting, but the previous electric nozzle design, which involved using a ceramic band heater externally of the nozzle, has been withdrawn from the market.

It would be advantageous to precisely control the temperature within a die-casting nozzle to an optimal temperature as an aid to process control. Simplicity of design and servicing are also highly beneficial in industrial equipment.

A brief discussion of some patents for heated nozzles and other fluid heaters in technologies other than die casting follows.

Krohn et al., U.S. Pat. No. 3,835,924, discloses a high pressure heater for paint including a cylindrical core having a continuous spiral groove in a surface of the cylinder. An electric heating element is axially centrally disposed in the core and paint flows through the spiral groove to be heated by the heating element.

Osuna-Diaz, U.S. Pat. No. 4,196,855, discloses a machine nozzle attached to the barrel of an injection molding machine for use in plastic injection molding. The nozzle includes a body having a central passage therein, the body surrounded by a coiled electric heater extending substantially the full length thereof. A cover surrounds the heater, and a removable retainer is attached to the end of the body.

Lehrke, U.S. Pat. No. 4,501,952, discloses a fluid heater, particularly for heating paint, lacquers, finishes and other spray coating material. The heater of Lehrke includes an elongated hollow tube adapted to be inserted into a fluid flow line for fluid flow through the tube. An electric resistance heater is axially centrally disposed within the tube, the heater being surrounded by a helical coil-shaped passage which creates a helical flow path through the tube around the heater.

Although the prior art provides a variety of heated tubes for various uses, a need still exists in the metal die casting industry for a heated nozzle which is designed and constructed specifically for metal die casting, and for a heated nozzle assembly including a control mechanism for controlling the nozzle to a desired temperature to control process variability.

SUMMARY OF THE INVENTION

The present invention provides an electrically heated nozzle apparatus having a nozzle which is placable between a metal injecting apparatus and a die to be filled with metal, the nozzle being controllable to a desired temperature to keep the metal in a molten state as it is transferred therethrough. It is an object of the invention to provide a nozzle which is particularly suited for use in metal die casting, and which is adjustable so as to be usable with dies of different heights.

It is a feature of the invention that the nozzle contains a passage formed therethrough which has a constant diameter throughout.

It is an advantage of the present invention that the nozzle hereof attains a relatively constant temperature throughout the length thereof, and is able to maintain that temperature within a narrow range.

A nozzle for use in metal die casting, in accordance with the present invention, comprises:

an outer sleeve;

a core member having an end cap and a core section disposed within the sleeve and having a hollow cylindrical flow passage formed therethrough, the flow passage being of a constant diameter throughout the length of the core member and having an inlet and an outlet;

a coil of electrical resistance heater wire wrapped around at least a portion of the core section; and means for regulating current flow through the heater wire to adjust the temperature of the nozzle.

The present invention may also include a control box which contains the current regulating means, and wires connecting the nozzle with the control box.

For a more complete understanding of the present invention, reference is made to the detailed description section. Throughout the following description and in the drawings, identical reference numbers are used to refer to the same component shown in multiple figures of the drawings, in which:

BRIEF DESCRIPTION OF THE DRAWINGS

FIG. 1 is a perspective view of a nozzle and control box therefor in accordance with the present invention;

FIG. 2 is a cross-section of the nozzle along the line 2—2 of FIG. 1;

FIG. 3 is a side elevational view, partially in cross-section, of a die casting machine utilizing the nozzle hereof;

FIG. 4 is an end view of the nozzle of FIG. 2; and

FIG. 5 is a partial cross-section of an alternative embodiment of a nozzle in accordance herewith.

DETAILED DESCRIPTION OF THE PREFERRED EMBODIMENT

Referring to the drawings, the nozzle assembly of the present invention is shown generally at 10 and includes a nozzle 12 and a control box 16 connected by a cord 18 containing at least two sets of wires, a power supply wire 20 and a thermocouple connection wire 21. As shown in FIG. 2, the nozzle 12 comprises an outer sleeve 14 having a generally tubular, cylindrical shape, and a hollow core member 15 disposed within the sleeve 14. In a preferred embodiment, the wall of the sleeve 14 is at least ¼ inch thick. The core member 15 surrounds a cylindrical flow passage 22 which is formed therewithin, and which has an essentially constant diameter throughout the length of the nozzle 12. The core member 15 extends substantially the entire length of the nozzle 12 so that the passage 22 is completely contained within a seamless unit. The passage 22 is contained within a single-piece unit, as noted, to avoid any possibility of leakage which might otherwise occur at the juncture of two interengaging pieces, which could have different coefficients of expansion if formed from dissimilar materials. The core member 15 includes an elongated tubular core section 17 which fits inside the sleeve 14, and a generally domed end cap 34 which is coaxial with the core section 17 and which has a plurality of cut away flattened faces formed around the periphery thereof to allow grasping thereof by a wrench in assembly or disassembly.

The end of the core section 17 opposite the end cap 34 is externally threaded to accommodate a nozzle tip 28 as will be further described herein.

The passage 22 within the core member 15 has an inlet 24 and an outlet 26, and is generally smooth and unbroken therein for the passage therethrough of molten metal in a die casting operation. The inner diameter of the passage 22 is constant throughout the core member 15 to avoid pressure buildup in operation. In one embodiment, both the sleeve 14 and the core member 15 are formed of high-grade steel for use in die casting zinc. A coil of electrical resistance heater wire 32 is wrapped around substantially the entire length of the core section 17 within the sleeve 14. The heater wire 32 may have a substantially square cross-section as shown in FIG. 2. The end cap 34 is formed with an inset shoulder 36 which seats within a flange 38 formed on the end of the sleeve 14 for coaxial alignment of the sleeve 14 with the core member 15.

In the embodiment of FIGS. 1-2, a nozzle tip 28 is provided which is internally threaded and removably attached to and surrounding the threaded end of the core member 15. The nozzle tip 28 is also of a generally domed shape with cutaway flattened faces 29 thereabout, and may also be formed of a high grade steel. The heated wire 32 may extend into the nozzle tip 28 as shown. The tip 28 has a rounded portion 30 formed at the forwardmost section thereof for insertion of the nozzle tip 28 into a die in a die casting operation. The tip 28 has a reduced diameter flange 46 extending around the circumference of a rear surface 56 thereof for engagement with a shoulder 48 of the sleeve 14 to coaxially align the tip 28 and the sleeve 14. A thermocouple 54 is provided in the tip 28 to provide data about the actual operating temperature of the nozzle 12 to a control box 16. The outlet 26 of the flow passage 22 is located coaxially within the rounded portion 30 of the nozzle tip 28.

The control box 16 includes several features which are convenient for use by a die casting operator. The control box 16 is constructed to be powered by a standard industrial current such as e.g., 110-volt, 220-volt, etc., and includes a conventional plug 33 for connecting the control box 16 to a source of current (not shown). The control box 16 includes an on-off switch 50 disposed thereon for energizing and de-energizing the nozzle. Means for regulating current flow to the heater wire is provided on the control box 16, the nozzle temperature 40 being controllable by a control knob 42. The control box 16 may also include a microprocessor 40 to aid in controlling the temperature of the nozzle 12. A suitable microprocessor for use in the present invention is sold by Watlow Controls, Winona, Minn. 55987, under the name "SERIES 985". An indicator 44 is also provided to indicate a selected operating temperature of the nozzle, and the indicator may also display the actual temperature at the thermocouple 54 in the nozzle tip. The indicator displays the temperature which corresponds to the setting of the control knob 42. The indicator can be an LED numeric display or other type of indicator known to those skilled in the art. The control knob 42 moves in the direction indicated by the arrows in FIG. 1.

Alternatively, push buttons may be used in place of knob 42 for more precise temperature control. In use, the nozzle 12 is disposed between a molten metal source 58 and a die 60 for pressurized injection of metal into the die. The source of metal may have a convex or rounded surface surrounding an outlet thereof for sealingly engaging with a concave surface 56 formed coaxially in the back face 54 of the end cap as shown in FIG. 5. In a similar fashion, the rounded portion at the forwardmost end of the nozzle tip 28 is inserted into a concave opening formed in a die 60.

It is an important feature of the present invention that the nozzle hereof is adjustable for use with the dies of differing heights, due to the fact that the ends of the nozzle are rounded and are either both convex, as shown in FIG. 2, or the end cap 54 may be concave, i.e., may have a concave face 56 formed therein, in the embodiment of FIG. 5. In either case, adjustability for use with dies of different heights is obtained by mating the rounded faces with correspondingly shaped surfaces on a furnace 58 and a die 60 on opposite ends of the nozzle 12.

In use, the control box is turned on and the nozzle is brought to and stabilized at a desired selected temperature such as, e.g., 1400° F., and molten metal is then injected by the metal source 58 into the passageway of the nozzle and thence into the die 60. The fact that the nozzle 13 is heated ensures that the molten metal enters the die at a precisely controlled optimal temperature and also prevents any metal from building up within the nozzle to restrict fluid flow therethrough. Also, as noted, the constant diameter of the passageway 22 throughout the nozzle 12 helps minimize pressure buildup therein. Serviceability is enhanced by the easily removable nozzle tip 28 allowing access to the thermocouple 54 and heater wire 32 within the housing. As shown in FIG. 1, the assembly 10 may include a stand 11 which may, optionally, be mounted on a plurality of wheels 13 to enhance portability thereof. The stand 11 may include curved brackets 80 for resting the nozzle 12 thereon when not in use.

The control box 16 is preferably removably mounted to the stand 11 by appropriate mounting hardware which will be readily understood by those in the art.

Although the present invention has been described herein with respect to specific embodiments thereof, it will be understood that the foregoing is intended to be illustrative, and not restrictive. Many modifications of the present invention will occur to those skilled in the art. All such modifications which fall within the scope of the intended claims are intended to be with the scope and spirit of the present invention.

Having, thus, described the invention, what is claimed is:

1. A nozzle assembly for use in metal casting, the nozzle assembly comprising:

(a) An outer sleeve;

(b) A unitary core member having an end cap and a core section disposed within the sleeve, the core member having a hollow cylindrical flow passage formed therethrough, the flow passage being of a constant diameter throughout the length of the core member and having an inlet and an outlet, the end cap having a rounded portion disposed adjacent the inlet of the flow passage;

(c) a nozzle tip, the nozzle tip surrounding the core member opposite the end cap, the nozzle tip having a rounded portion adjacent the outlet of the flow passage;

(d) A coil of electrical resistance heater wire wrapped around at least a portion of the core section;

(e) means for regulating current flow through the heater wire to adjust the temperature of the nozzle; and wherein the curved portions of the nozzle cooperate to permit for easy insertion into a die and a furnace and to permit adjustability for varying die heights.

2. The nozzle assembly of claim 1, further comprising means for indicating a temperature corresponding to a particular setting of the adjusting means.

3. The nozzle assembly of claim 1, further comprising a control box which contains the adjusting means, and a pair of wires connecting the nozzle with the control box.

4. The nozzle assembly of claim 1, further comprising an end cap for retaining a housing on the sleeve, the end cap being integral and coaxial with the sleeve and having a portion of the flow passage formed therein, the end cap disposed at an end of the nozzle opposite the tip and having a concave surface coaxial with the flow passage formed thereon for engagement with a source of metal to be injected into a die.

5. The nozzle assembly of claim 4, further comprising:

a control box for the nozzle, the regulating means, being housed in the control box;

a pair of wires connecting the coil of heater wire to the control box;

an on-off switch disposed on the control box for energizing and de-energizing the nozzle; and means on the control box for indicating a selected temperature of the nozzle.

6. The nozzle assembly of claim 1 wherein the rounded portion of the end cap is convex.

7. The nozzle assembly of claim 1 wherein the rounded portion of the end cap is concave.

8. The nozzle of claim 1 wherein the rounded portion of the nozzle tip is convex.

* * * * *